US005149401A

United States Patent [19]

Langevin et al.

[11] Patent Number: 5,149,401

[45] Date of Patent: Sep. 22, 1992

[54] SIMULTANEOUSLY CONTROLLED STEAM SHOWER AND VACUUM APPARATUS AND METHOD OF USING SAME

[75] Inventors: Eric T. Langevin, Northboro; James A. Bourque, Sudbury, both of Mass.

[73] Assignee: Thermo Electron Web Systems, Inc., Auburn, Mass.

[21] Appl. No.: 785,143

[22] Filed: Oct. 29, 1991

Related U.S. Application Data

[63] Continuation of Ser. No. 682,435, Apr. 8, 1991, abandoned, which is a continuation-in-part of Ser. No. 487,772, Mar. 2, 1990, abandoned.

[51] Int. Cl.[5] ..... F26B 13/02; F26B 21/06; D21F 5/14

[52] U.S. Cl. ..... 162/207; 34/23; 34/34; 34/54; 162/290; 162/375; 162/252

[58] Field of Search ..... 162/207, 208, 290, 308, 162/359, 375, 252; 34/34, 54, 23

[56] References Cited

U.S. PATENT DOCUMENTS

| | | | |
|---|---|---|---|
| 3,945,881 | 3/1976 | Speidel | 112/208 |
| 4,331,510 | 5/1982 | Wells | 162/290 |
| 4,545,857 | 10/1985 | Wells | 162/252 |
| 4,580,355 | 4/1986 | Boissevain | 162/207 |
| 4,662,398 | 5/1987 | Wywailowski et al. | 162/207 |
| 4,765,067 | 8/1988 | Taylor | 162/207 |

FOREIGN PATENT DOCUMENTS

| | | | |
|---|---|---|---|
| 2189270 | 10/1987 | United Kingdom | 162/359 |

*Primary Examiner*—Karen M. Hastings
*Attorney, Agent, or Firm*—Lorusso & Loud

[57] ABSTRACT

Method and system for applying steam to a paper forming web for the purpose of heating the web to improve the quality of the paper, and withdrawing steam through the use of a vacuum opposite the steam shower, by the simultaneously controlled removal of steam at equally spaced increments by the use of a computer based control system. The computer based control system includes a selectively actuable stepper motor, to effectuate the simultaneous opening of both the steam valve and opposing withdrawal means valve. The system includes a coanda nozzle to cause steam to travel between the sheet and the adjacent surface of the apparatus in a direction opposite to the direction of travel of the sheet and also includes steam impingement nozzles. The apparatus includes devices for creating, housing and providing a supply of steam and a supply of vacuum.

7 Claims, 6 Drawing Sheets

SIMULTANEOUSLY CONTROLLED STEAM SHOWER AND VACUUM APPARATUS AND METHOD OF USING SAME

CROSS-REFERENCE TO RELATED APPLICATIONS

This is a continuation of co-pending application, now abandoned, Ser. No. 07/683,435 filed on Apr. 8, 1991, now abandoned, which is a continuation-in-part of application, USSN 07/487,772 filed Mar. 2, 1990 and entitled "Steam Shower and Vacuum Apparatus and Method of Using Same", now abandoned.

BACKGROUND OF THE INVENTION

This invention relates to papermaking and more particularly to an apparatus and a method for controlling the temperature of a web or sheet of paper as it enters the press section through the utilization of a stepping motor to open and close valve pipes in order to control the application of steam against the sheet surface and the corresponding withdrawal of the steam by a suction device through the opposite side of the sheet that contacts the forming fabric (wire).

In the forming section of a paper making machine, water is removed from the pulp to form a web. The drainage rate of the water is proportional to the viscosity and surface tension of the trapped water. Further water expression (removal) is accomplished in the press section. Increasing sheet temperature decreases the water viscosity and surface tension, hence augmenting the expression of water. As shown in U.S. Pat. Nos. 3,574,338, 3,945,570, 4,050,630 and 4,163,688, it is common practice to apply steam to a sheet in the forming section and prior to the sheet entering the press section so that the latent heat of the steam increases the temperature of the sheet.

It is a common practice to utilize a vacuum source beneath the web to remove water. The vacuum source can also serve to draw the steam into the web and increase steam penetration. This increased steam penetration serves to increase the operating efficiency of the steam shower and the heat transfer to the web. This vacuum source is typically run at a constant uniform vacuum level in the transverse or cross direction (CD) without any regulation of volume once the machine has stabilized.

The press section of a paper making machine is located before the dryer section. Therefore, increasing the water removal rate through the press section serves to decrease the moisture content of a sheet entering the dryer section, thereby either reducing the energy consumption required to further dry the sheet or increasing production (speed) at constant dryer section energy consumption.

Typically when steam is applied to a section of the web or sheet with excess moisture, the steam will migrate to an alternate section of the web or sheet where there is less moisture before it penetrates the web. This happens because where there is less moisture the opposing vacuum system works "better" and actually more suction gets through the web to withdraw the steam. This tends to exaggerate rather than solve the moisture problem. This invention se&s out to eliminate this "steam migration" problem by applying vacuum to the appropriate section effectively preventing the steam from travelling to a "dry spot" in the web. Water expression is also proportional to the level of vacuum applied. Thus applying higher vacuum to that portion of the web with higher moisture increases the water removal rate.

In any steam application, consumed steam should be maximized for its effective use. To maximize the effective usage, the percentage of consumed steam that condenses on and in the sheet for the purpose of raising the sheet temperature should be maximized, and the percentage of consumed steam that does not condense but instead exhausts to the atmosphere as wasted energy should be minimized.

There are certain applications where the steam application does not have to be positionally and volumetrically controlled. In other applications however, it is necessary to impart steam to the process in controlled amounts at specified positions across the machine for profiling certain sheet qualities. This controlled imparting of steam is commonly performed as part of a closed-loop control system, where the sheet quality variable in question is scanned on-line at equally spaced increments across the machine. The results obtained by the scanning device, through the use of computer analysis, are used to automatically control the steam flow applied to the sheet in accordance with the desired sheet quality criteria.

The ability of known steam shower apparatus to repeatedly apply a uniform steam flow is presently limited to the accuracy and repeatability of pneumatically actuated control valves.

For the same reasons that it is important to accurately control the steam flow to the sheet, it is also important to maintain uniform heat-transfer, over the portion of the sheet in question.

SUMMARY OF THE INVENTION

According to the present invention, a steam shower apparatus is provided for use in controlling the temperature of a sheet by applying steam against the upper surface of the sheet. Directly beneath this steam application zone is a corresponding vacuum zone. The vacuum zone's purpose is to enhance profilability and increase the response of the steam shower itself. The vacuum zone acts as the bottom half of a steam-web-vacuum sandwich.

The controlled application of steam across the machine at equally spaced increments can be employed to control the initial and hence final moisture profile of the sheet. The controlled removal of moisture/steam at such equally spaced increments is accomplished by the use of a measurement computer system which controls a stepping motor. The stepping motor in turn controls the appropriate valves in both the vacuum and steam zones in order to send a certain amount of both vacuum and steam to the web. This process varies the amount of steam application and vacuum volume directly beneath the steam application zone. This can be accomplished because directly beneath the steam application zone is a vacuum steam removal zone of similar dimensions. When the output of steam is increased through the steam box the vacuum beneath this individual zone is increased. This combination of steam application and steam removal serves to enhance the effectiveness of the process as well as enable the operators to have better control of the web's profile. The marrying of the steam application to the vacuum source insures that the steam goes where it is intended. The vacuum could be increased without changing the steam rate to increase water removal.

Accordingly, the principal object of the apparatus is to make maximum usage of generated steam and efficiently utilize the energy required for generating steam when applying steam to a paper web.

A further object of the present invention is to provide a steam shower apparatus for a paper making machine which applies steam in such a way that the entrainment of non-condensable air into the condensation space, which severely hampers condensation heat transfer, is limited or eliminated.

Another object of the present invention is to provide a steam shower apparatus for a paper making machine that allows for improved accuracy and repeatability of steam flow control, vacuum flow and level control.

Still another object of the present invention is to provide a steam shower apparatus for a paper making machine that applies steam to a sheet in such a way that uniformity of heat-transfer is provided in the cross-machine direction (non-uniformity is necessary for profile correction).

Yet another object of the present invention is to eliminate the moisture condensation on the outermost surfaces of the apparatus to prevent dripping on the sheet traveling through the apparatus.

These and other features and objects of the present invention will be more fully understood from the following detailed description which should be read in conjunction with the several figures in which corresponding reference numerals refer to corresponding parts throughout the several views.

DESCRIPTION OF THE PREFERRED EMBODIMENTS

At the outset the present invention is described in its broadest overall aspects with a more detailed description following.

Figure 1:
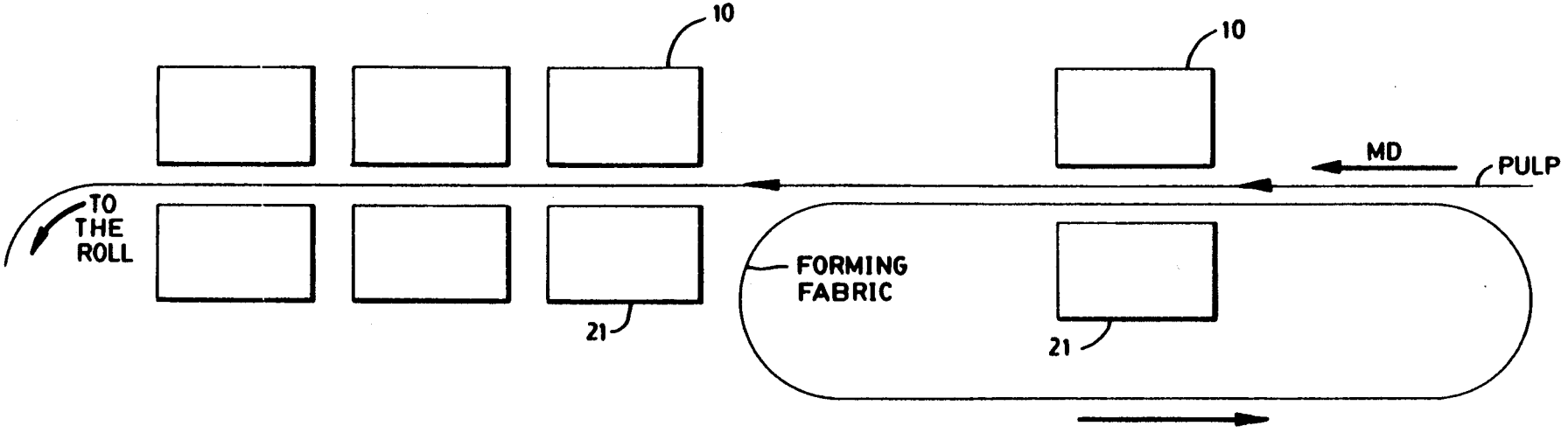
FIG. 1 is a schematic view of a portion of a paper making machine including the steam shower/vacuum apparatus of the present invention.

In it's broadest overall aspects the present invention is a steam profiling apparatus which includes steam showers 10, positioned at strategic locations on the paper making machine, with a device 21 for creating a vacuum 21, positioned directly beneath the steam shower. As is shown in FIG. 1, a steam shower vacuum combination is positioned on the forming section of a paper making machine with one or more additional steam shower vacuum couples positioned so that the web flows between them after it leaves the forming section of the paper making machine and before it enters the press section. In the preferred embodiment, the steam shower extends across the entire width of the paper making machine producing a line of steam in the cross machine direction. The vacuum positioned directly beneath the steam shower also has a vacuum chamber which extends beneath the steam shower so as to produce a zone of lower pressure directly beneath the zone where the steam is being applied to the web.

Figure 2:
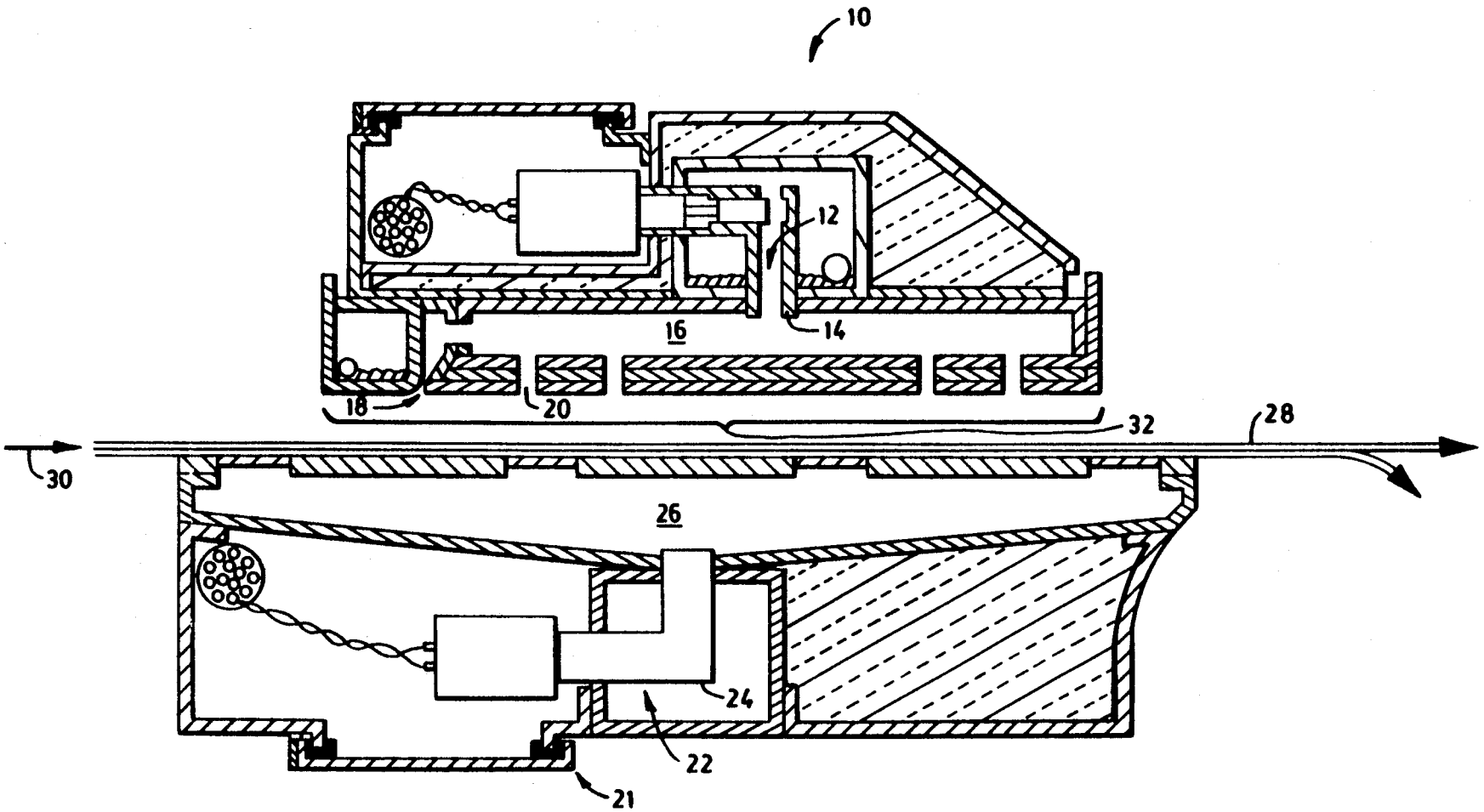
FIG. 2 is a sectional view of a steam shower/vacuum apparatus of the present invention, positioned adjacent to the sheet, employing positional steam flow control and positional vacuum flow control.

As shown in FIG. 2, the steam apparatus 10 includes a steam supply manifold 12 which applies steam through a feed pipe 14 to a chamber 16 leading to a combination Coanda nozzle 18 and impingement nozzle 20. The vacuum apparatus 21 includes a vacuum supply manifold 22 which through a feed-pipe 24 reduces the pressure in a chamber 26 that is positioned parallel to and directly beneath the steam zone discussed above. The Coanda nozzle 18 is arranged in the apparatus so that the steam flowing through the Coanda nozzle 18 is directed along a surface of the apparatus 10 which is positioned adjacent and parallel to a sheet 28 which is to be heated. The steam flows in a direction opposite to the direction of travel of the sheet. The direction of travel of the sheet is shown by arrow 30. The main purpose of this Coanda nozzle 18 is to remove the boundary layer of entrained air traveling with the sheet 28. This layer of air normally acts as an insulator preventing the steam from penetrating the sheet 28. Additionally, the corresponding vacuum chamber 26 is located opposite the steam nozzles 18 and 20 to maximize the amount of steam drawn into the web and subsequently increase profilability.

A preferred embodiment of the present invention includes means for heating the outside bottom surface of the apparatus to prevent discharge steam condensing thereupon and dripping moisture on the sheet. For example, the outside bottom surface could be heated electrically, for example with an electrical resistance heater. In another variation, the steam supply manifold is located in the lower portion of the apparatus so that the bottom wall of the apparatus is also the bottom wall of the steam supply manifold. In still another variation, the apparatus is mounted above the traveling sheet so that a downstream corner of the apparatus contacts the web so that steam is back pressured between the sheet and the apparatus.

Figure 8:
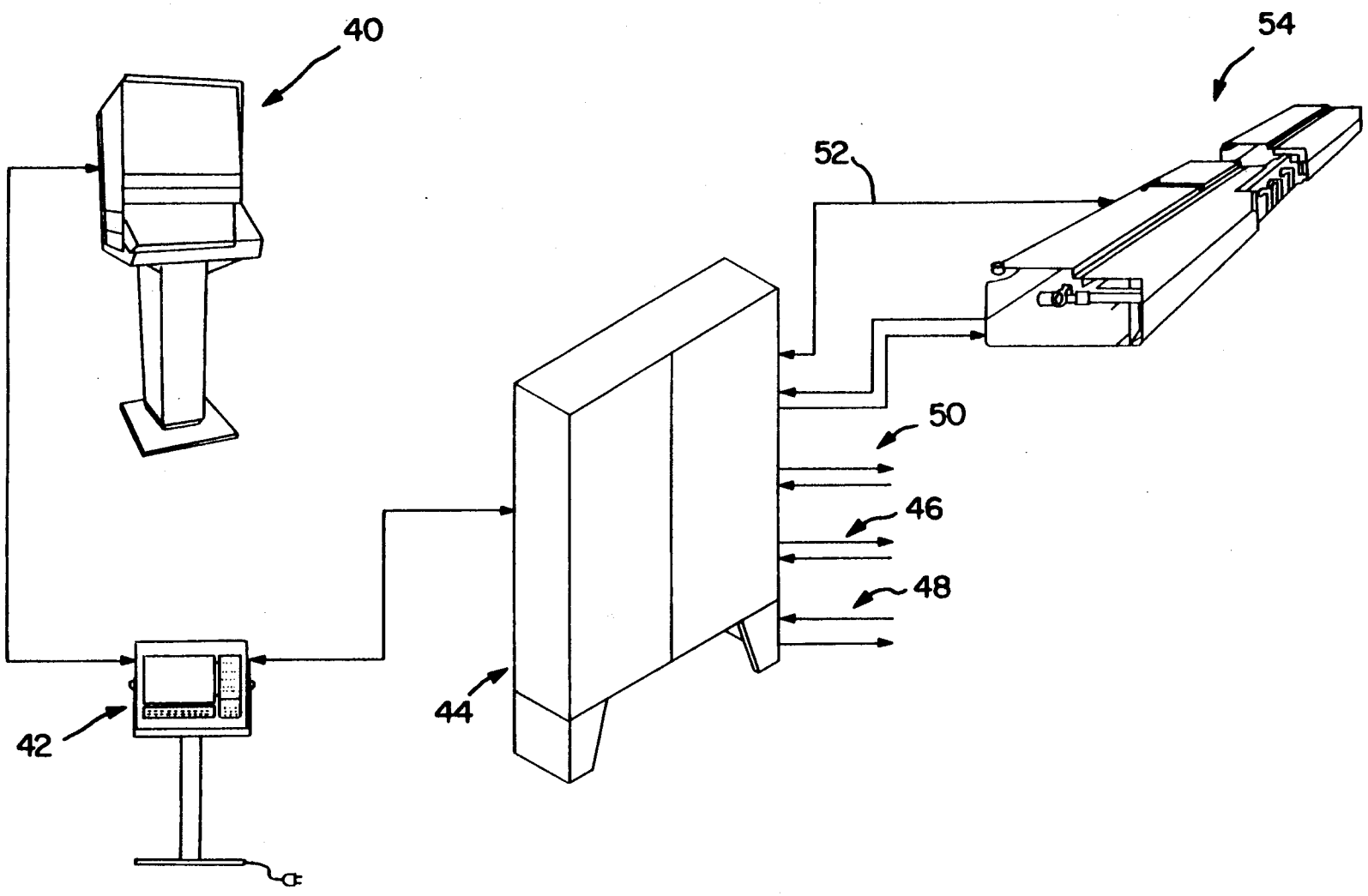
FIG. 8 is a schematic view of the computer control system which controls the amount of both steam and vacuum applied to the web.
Figure 9:
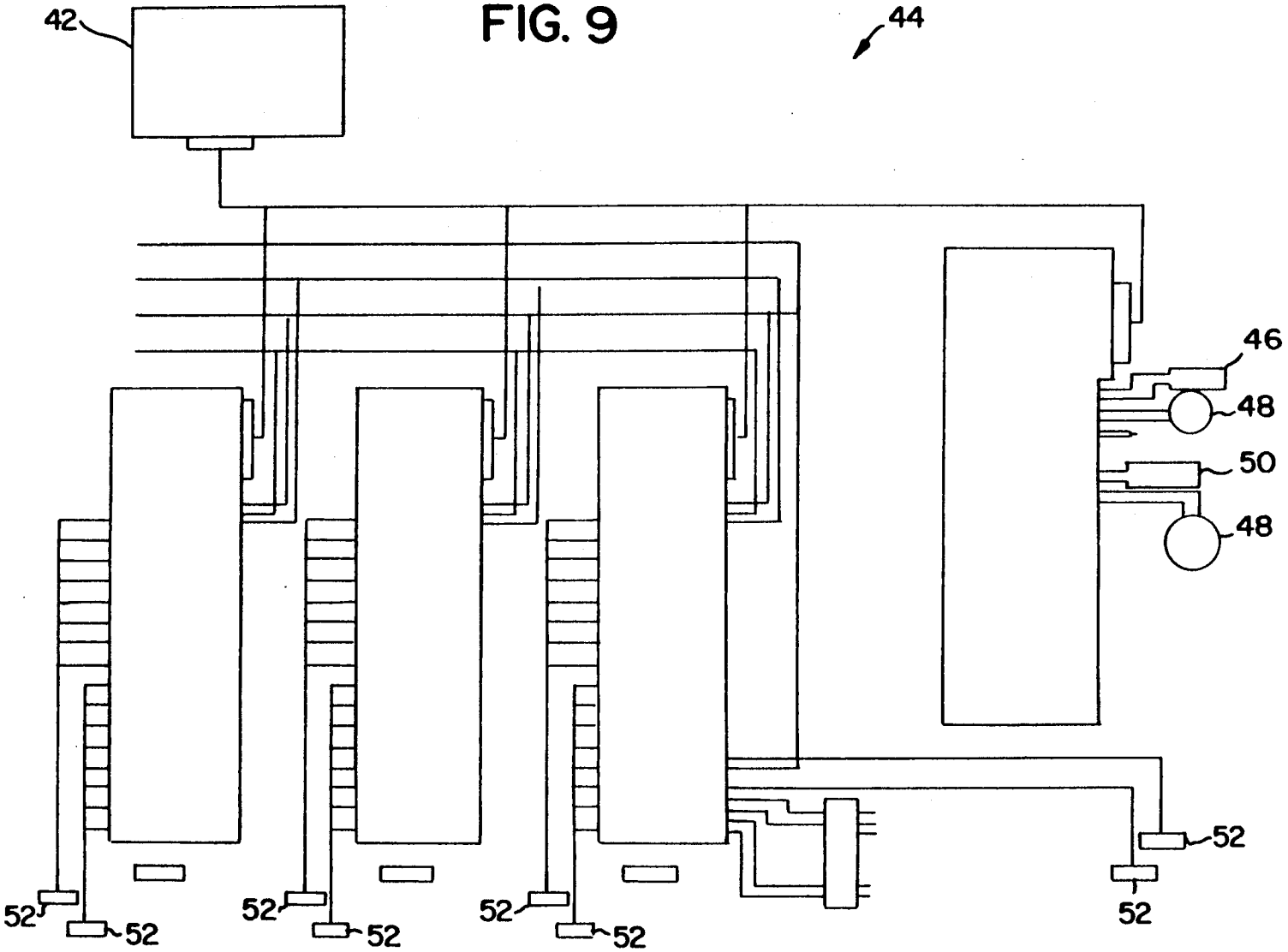
FIG. 9 is a schematic view of the logic control panel shown in FIG. 8.

The key to this invention is the marriage of the two devices (steam shower and vacuum chamber) with both the steam and coordinate control system. The control system will adjust the vacuum section beneath the steam section as appropriate. Quite simply this system will recognize when it is necessary for it to increase or decrease steam and/or vacuum flow and react accordingly. Currently, those methods available are limited to profilable steam boxes and non-profilable vacuum boxes. The present invention is a new device (i.e. profilable vacuum system coupled to a profilable steam system) that requires the sophistication of a combined control system to operate effectively. This is shown in FIGS. 8 and 9. This is done by the use of a measurement computer system 40. The measurement computer system 40 measures the quality of the paper which is affected by the steam shower and vacuum apparatus. The measurement computer system 40 then electrically sends a signal to the operator's console 42. The operator's console 42 interprets the signal and sends a signal to the logic control panel 44. The logic control panel 44 receives the computer's signal and outputs instructions 52 for the stepper motor chamber to control the appropriate valves in both the vacuum zone and the steam zone 54 which will adjust the inlet orifices in both the vacuum and steam zone, and ultimately send a certain amount of both vacuum and steam to the web. In addition, the logic control panel 44 controls aspects of the steam by analyzing the pressure 46 and temperature 50 of such steam and sending a signal 48 to the steam supply before the steam enters the apparatus. If, for instance, the vacuum system was not operated in conjunction with an opposing steam shower, its effect on moisture control or web preheating would be minimal. The vacuum section serves to enhance the effectiveness of the steam shower by increasing the percentage of steam brought into the sheet at the appropriate location and limiting the migration of steam to adjacent locations.

As is stated above, the purpose of a conventional profiling steam shower is to correct moisture inconsistencies in the web. The steam shower does this by applying steam to those sections that have more moisture than desired, effectively preheating those particular sections of the web. As the web is passed through the dryer the excess moisture which has been preheated will evaporate sooner, thus actually reducing the moisture level in that section.

Without simultaneous control of the steam shower and the vacuum system, *too* much operator interaction would be necessary for the system to be effective. This invention's purpose is to allow the computer to tie into a closed loop measurement gauge, or to allow an operator to push a single control and have the appropriate steam valve open as well as have the opposing vacuum valve open. The complex interactions between steam, vacuum and water removal are not readily reduced by machine operators, therefore the computer based control system, shown in FIG. 8, is necessary to obtain the maximum benefit from this actuator pair. Therefore, it is essential to marry these two devices together to ensure proper operation.

The steam shower apparatus for supplying steam to a web or sheet includes an air-foil type nozzle, utilizing the Coanda effect, to impart steam in a direction roughly parallel but opposite in direction to the direction of travel of the sheet. This Coanda effect steam foil blocks the boundary layer of entrained air traveling with the sheet and subsequently serves to increase efficiency. In the interest of limiting the entrainment of non-condensible air into the condensing-space located between the apparatus and the sheet, the counter parallel-flow nature of the system insures that the exhausting steam creates a positive pressure "wall" at the incoming or downstream edge of the apparatus, thereby decreasing the volume of air which can be entrained by the moving sheet. At the outgoing or upstream edge of the apparatus, the velocity of the sheet serves to limit the volume of air entering the condensing space, close to the surface of the exiting sheet.

An additional feature of the invention is that the high velocity counter-flow running parallel to the sheet insures that even after exhausting at the upstream edge, a significant percentage of the non-condensed steam continues to flow roughly parallel to the sheet for a considerable distance, effectively preheating the sheet before it actually enters the apparatus. This non-condensed steam thereby serves to effectively utilize some of the exhaust steam which would otherwise be wasted.

In addition to the Coanda nozzle, the steam shower utilizes a unique hole pattern to impart steam into the web via impingement, thereby insuring uniformity of steam flow and heat transfer in the cross-machine direction at the desired positional location. The Coanda nozzle blocks the boundary layer of entrained air and preheats the web while the impingement nozzle applies pressurized steam into the web. This combination of the two application techniques maximize the efficiency of the steam shower itself.

Both steam and vacuum are supplied to the apparatus and conveyed across the machine width by an oversized distribution header (typically having a ten inch diameter) to insure uniform supply distribution across the machine, feed-pipes (typically having a two inch diameter) located normal to the axis of the supply manifold traverse the diameter of the supply manifold.

Any undesirable condensation in the supply manifold, being heavier than vapor, collects in the bottom of the manifold where it is bled to drain at the rear of the apparatus. The removal of condensation from the manifold insures that condensation in the nozzle exit-flow is minimized.

Figure 7:
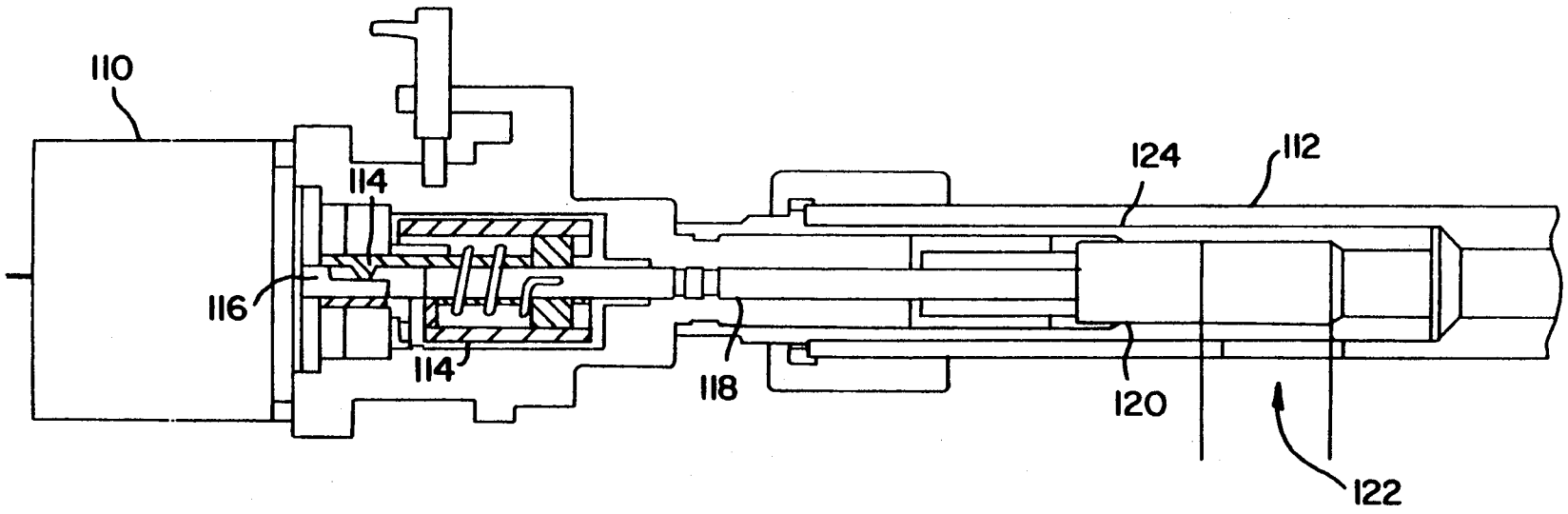
FIG. 7 is a sectional view of a stepper motor with valve body positioned within both the steam and vacuum zones.

In a preferred embodiment, the impingement chamber 16, shown in FIG. 1, and corresponding nozzle are divided into several chambers and associated nozzles by positioning baffles around several feed pipes. Each of the these feed pipes is connected to a direct-current stepper motor. As shown in FIG. 7, a direct-current stepping motor !10 is mounted on the outboard end of a feed-pipe 112. A valve pipe 124 is located within the feed-pipe 112. A lead-screw type coupling 114 connects a stepping motor shaft 116 to a valve stem 118 which connects to a translating valve-poppet 120 located in the body of the feed-pipe in the region of an inlet orifice 122. As the stepper motor shaft 116 changes its position, it turns the coupling 114, which causes the valve stem 118 to move longitudinally toward the valve poppet 120. The valve poppet 120 is moved to open or close the orifice 122 in the valve pipe 124. This is done to either totally close the orifice 122 to prevent steam in the steam zone, and vacuum in the vacuum zone from entering the valve pipe 124 at the inlet orifice 122 or to partially close the orifice 122 to thereby adjust the volume of steam and vacuum entering the valve-pipe 124. Positioning of the stepper motor shaft angle translates the valve poppet 120 so as to increase or decrease the available open-area of the feed-pipe inlet orifice. As a result, the flow-rate of steam through the feed-pipe inlet orifice may be controlled, thereby enabling the controlled application of steam to the sheet.

The choice of a stepping-motor 110 as the preferred type of valve actuator is particularly important to the accuracy and repeatability of the control process. The small angular increments of shaft position 116 (typically 2 degrees per step), combined with the turn-down ratio of the lead-screw coupling 114 combine to provide approximately 5000 precise and repeatable available valve-poppet 120 positions over a total valve-poppet travel of one inch. The specific values cited above may be changed in accordance with specific design requirements, but this example serves to indicate the extraordinary control definition, accuracy and repeatability available with such an actuator.

In addition to the above stated features, an attractive aspect of the stepping-motor actuator is that it may be electrically coupled through actuator lines, directly to a computer control system, as seen in FIGS. 8 and 9. Such coupling eliminates the need for any intermediate signal conversion (i.e. from electric to pneumatic), with an attendant presumed improvement in both control, accuracy and repeatability.

The stepping-motor actuator, of course, may be replaced by any type of actuator which will operate a poppet-like device to provide the desired steam flow control.

The main body of the apparatus is insulated about the supply-manifold with suitable insulation to minimize the likelihood of condensation carry-over and to maximize the usage of the steam latent heat for the purpose intended.

The apparatus includes two separate structural chambers, the manifold/nozzle chamber 16 (which in the preferred embodiment is of fixed standardized length) and the control chamber 12 (which in the preferred embodiment is of variable length). The variable length may be chosen so as to provide the apparatus length required to aid in the attainment of the necessary steam condensing rate for each specific application. Alternatively, both lengths may be chosen as fixed values, so as to provide a fixed apparatus length deemed to be satisfactory for the attainment of successful performance over the full range of expected applications.

In certain applications, it is important that no moisture other than that resulting from film condensation at the steam-sheet interface is deposited on a sheet traveling through the apparatus. Under certain conditions in the embodiments described above, moisture condenses on the bottom surface of the apparatus and eventually drips onto the sheet. It has been found that by maintaining the temperature of the outside surface above 180 degrees Fahrenheit, no discharged steam condenses on the outside bottom surface because the surface is too hot for any condensation to occur at atmospheric conditions. As a result there is no dripping of moisture on the sheet.

Figure 3:
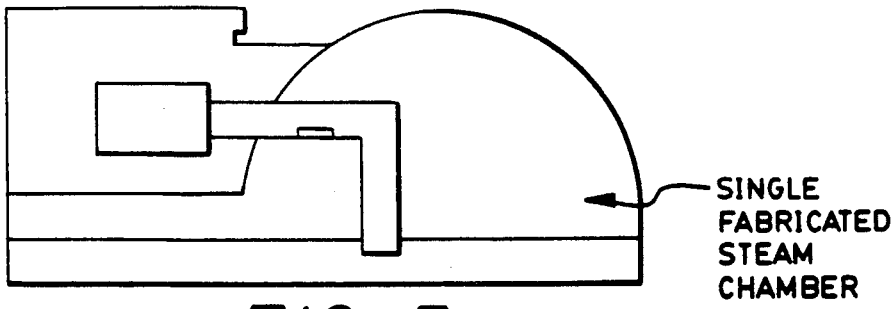
FIG. 3 is a sectional view of an alternate embodiment of the steam shower/vacuum apparatus shown in FIG. 1 in which the bottom surface of the apparatus is heated by a resistance electrical heater.

Maintaining this temperature can be achieved in various ways. The bottom surface of the apparatus can be heated electrically, by means conventional to the art. For example, the bottom surface can be heated with a resistance electrical heater, as shown in FIG. 3. In addition, modifications can be made in the structure of the apparatus to achieve the requisite goals.

Figure 4:
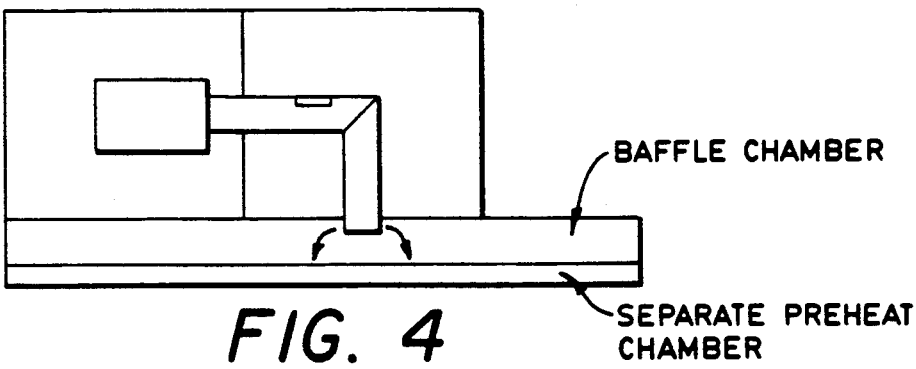
FIG. 4 is a sectional view of a further alternate embodiment of the steam shower/vacuum shown in FIG. 1 in which the steam supply manifold forms the bottom portion of the apparatus.
Figure 5:
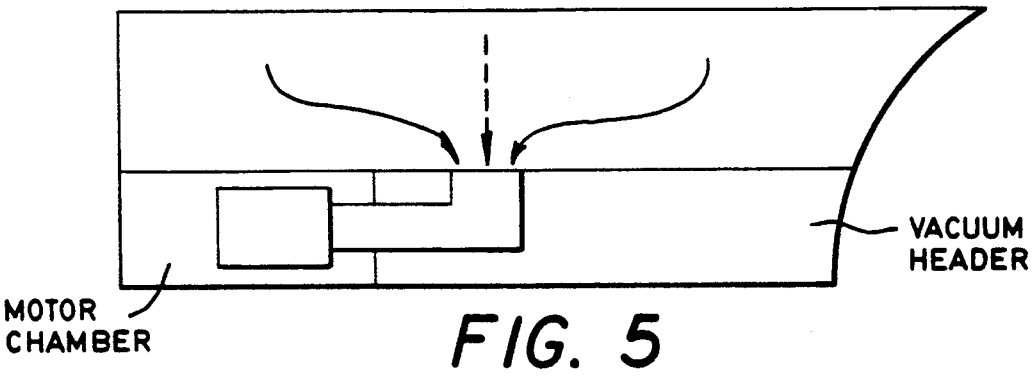
FIG. 5 is a sectional view of an additional embodiment of the steam shower/vacuum apparatus shown in FIG. 5.
Figure 6:
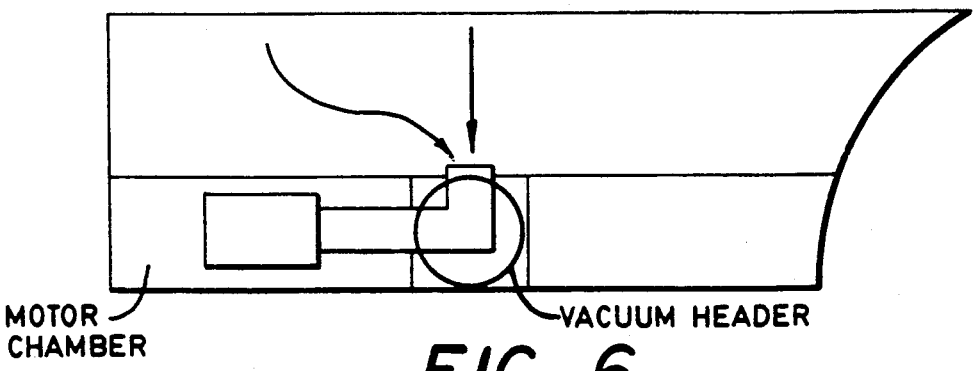
FIG. 6 is a simplified plan view of another embodiment of the steam shower/vacuum apparatus shown in FIG. 6 with only the steam supply manifold of the apparatus being shown.

The embodiment of the steam shower apparatus shown in FIG. 4 also eliminates this condensation. In FIG. 4, the steam supply manifold is configured so that the steam supply manifold constitutes the entire bottom surface of the apparatus. Steam within the steam supply header is either at a sufficient pressure (approximately 5–15 psig) or at a sufficient superheat temperature to insure that the temperature of the outside bottom surface 146 is above 180 degrees Fahrenheit.

Steam can also escape from the downstream side of the apparatus because the sheet may carry steam as it exits the apparatus. Steam can also leak out at the upstream side of the apparatus which is much cooler than bottom surface. This condensed steam then drips on the sheet and may result in sheet irregularities. To prevent this dripping, drip shields are positioned at the downstream and upstream edges of the apparatus respectively. The shield is an extension of the bottom surface so that the temperature of this shield is approximately the same as the bottom surface. As a result any steam striking this shield will be vaporized by the shield, and any other steam that passes around the shield and condenses on the apparatus will fall into the pocket created between the shield and the apparatus. This collected water may then be drained away.

The foregoing invention has been described with reference to its preferred embodiments. Various alterations and modifications will, however, occur to those skilled in the art.

The "steam shower" apparatus could be constructed of a reduced cross-machine length, in any of the embodiments, to provide an apparatus whose function is to operate over only a reduced percentage of the actual paper-machine width.

These and other alterations and modifications are intended to fall within the scope of the appended claims.

What is claimed is:

1. A system for applying and withdrawing a flow of steam to a paper forming web for the purpose of heating the web to improve the quality of the paper to be formed, said system comprising:

a forming fabric endless belt for supporting the web substantially in a plane in a paper making machine;

a steam apparatus disposed over said belt for directing a supply of steam directly onto an upper surface of the web; said steam apparatus comprising a steam supply manifold and a steam chamber interconnected by a feed pipe, a lower wall of said steam apparatus forming a bottom wall of said steam chamber, said lower wall defining a plurality of impingement nozzles spaced in a direction of travel of said belt, and disposed proximate said upper surface of said web, said impingement nozzles being uniformly spaced from said web, said lower wall further defining at least in part a Coanda nozzle, said Coanda nozzle being disposed proximate a forward edge of said steam apparatus and being configured so as to direct steam forwardly therefrom parallel to said belt and in a direction opposite to the direction of travel of said belt;

a vacuum apparatus for withdrawing the supply of steam, said vacuum apparatus being located opposite and directly beneath said apparatus for applying the steam and beneath said belt; said vacuum apparatus having a vacuum chamber underlying all of said steam chamber and extending beyond said steam chamber forwardly and rearwardly of forward and rearward walls of said steam apparatus, said vacuum chamber being defined in part by a planar upper surface parallel to, and separated from, said steam apparatus lower wall and thereby uniformly proximate said nozzles, and means for simultaneous control of the steam supply apparatus and said vacuum withdrawal apparatus.

2. The system of claim 1, wherein the simultaneous control of the steam apparatus and vacuum withdrawal means is provided by a computer based control system to effectuate the simultaneous opening of both a steam supply valve and an opposing vacuum chamber valve.

3. The system of claim 2, wherein said means to provide a computer based control system further comprises a selectively actuable stepper motor.

4. A method for controlling the temperature of a web to be formed into paper comprising steps of causing the web to travel on a forming fabric endless belt substantially in a plane in a paper making machine, between a steam apparatus, said steam apparatus disposed over said belt directing a supply of steam directly onto an upper surface of the web; said steam apparatus comprising steam supply manifold and a steam chamber interconnected by a feed pipe, a lower wall of said steam apparatus forming a bottom wall of said steam chamber, said lower wall defining a plurality of impingement nozzles spaced in a direction of travel of said belt, and disposed proximate said upper surface of said web, said impingement nozzles being uniformly spaced from said web, said lower wall further defining at least in part a Coanda nozzle, said Coanda nozzle being disposed proximate a forward edge of said steam apparatus and being configured so as to direct steam forwardly therefrom parallel to said belt and in a direction opposite to the direction of travel of said belt; and a vacuum apparatus for withdrawing the supply of steam, said vacuum apparatus being located opposite and directly beneath said apparatus for applying the steam and beneath said belt; said vacuum apparatus having a vacuum chamber underlying all of said steam chamber and extending beyond said steam chamber forwardly and rearwardly of forward and rearward walls of said steam apparatus, said vacuum chamber being defined in part by a planar upper surface parallel to, and separated from, said steam apparatus lower wall and thereby uniformly proximate said nozzles, and simultaneously controlling the steam supply apparatus and said vacuum withdrawal apparatus, by increasing the withdrawal of the vacuum chamber opposite the steam supply as the opposite steam supply application is increased.

5. The method of claim 4, wherein the simultaneous control of the steam apparatus and vacuum withdrawal means is provided by a computer based control system to effectuate the simultaneous opening of both a steam supply valve and an opposing vacuum chamber valve.

6. The method of claim 5, wherein said control system further comprises a selectively actuable stepper motor.

7. The method of claim 5, wherein said steam is supplied through a feed pipe which is connected to a stepper motor which is coupled to a valve poppet which opens and closes an orifice to thereby adjust the volume of steam.

* * * * *